US007540729B2

(12) United States Patent
Schneider

(10) Patent No.: US 7,540,729 B2
(45) Date of Patent: Jun. 2, 2009

(54) VANE CELL PUMP

(75) Inventor: Willi Schneider, Bodelshausen (DE)

(73) Assignee: Joma-Hydromechanic GmbH (DE)

( * ) Notice: Subject to any disclaimer, the term of this patent is extended or adjusted under 35 U.S.C. 154(b) by 1 day.

(21) Appl. No.: 11/846,058

(22) Filed: Aug. 28, 2007

(65) Prior Publication Data

US 2007/0292292 A1 Dec. 20, 2007

Related U.S. Application Data

(63) Continuation of application No. PCT/EP2006/009214, filed on Sep. 22, 2006.

(30) Foreign Application Priority Data

Oct. 6, 2005 (DE) ..... 10 2005 048 602
Apr. 28, 2006 (DE) ..... 10 2006 021 252

(51) Int. Cl.
*F03C 2/00* (2006.01)
*F03C 4/00* (2006.01)

(52) U.S. Cl. ..... 418/173; 418/259; 418/260; 418/268

(58) Field of Classification Search ..... 418/172, 418/173, 259, 260, 266–268
See application file for complete search history.

(56) References Cited

U.S. PATENT DOCUMENTS 2,064,635 A * 12/1936 Stern ..... 418/173
2,250,947 A 7/1941 Carpenter, Jr.
2,485,753 A * 10/1949 Lefler et al. ..... 417/271
3,223,046 A 12/1965 Eickmann
5,190,447 A * 3/1993 Schneider ..... 417/356

FOREIGN PATENT DOCUMENTS

| | | | | |
|---|---|---|---|---|
| BE | 393 530 A | | 2/1933 | |
| DE | 10 23 850 B | | 2/1958 | |
| DE | 195 04 220 A1 | | 8/1996 | |
| DE | 195 32 703 C1 | | 11/1996 | |
| DE | 196 31 974 A1 | | 2/1998 | |
| DE | 100 40 711 A1 | | 3/2002 | |
| GB | 319 467 A | | 9/1929 | |
| JP | 02169882 A | * | 6/1990 | ..... 418/173 |
| WO | WO 2007/039136 A1 | | 4/2007 | |

OTHER PUBLICATIONS

International Search Report.

* cited by examiner

*Primary Examiner*—Theresa Trieu
(74) *Attorney, Agent, or Firm*—Brinks Hofer Gilson & Lione

(57) ABSTRACT

The disclosure relates to a vane cell pump having an inner rotor (12) and a plurality of vanes (18) which are secured in a pivotable manner to the external rotor (28) and which are displacably mounted in a radial manner in the inner rotor, essentially in radial slots (16). The external rotor is formed on guide blocks (22). Said guide blocks are guided, with the axial front sides thereof, on the guiding path and are guided along the internal circumferential surface of a stator (26). The guiding path is arranged in a guide ring (36).

12 Claims, 2 Drawing Sheets

VANE CELL PUMP

CROSS-REFERENCE TO RELATED APPLICATIONS

This application is a continuation of International Application No. PCT/EP2006/009214 filed on Sep. 22, 2006, which claims the benefit of German Application No. 10 2005 048 602.9, filed Oct. 6, 2005 and German Application No. 10 2006 021 252.5, filed Apr. 28, 2006. The disclosures of the above applications are incorporated herein by reference.

FIELD

The invention relates to a vane cell pumps.

BACKGROUND

The statements in this section merely provide background information related to the present disclosure and may not constitute prior art.

A vane cell pump with an annular inner rotor is known from DE 100 40 711 A1 in which a plurality of vane elements extending radially outwardly is accommodated radially moveable. The radially internal end-regions of the vane elements are supported on a torsion-resistant central element, the radially external lying end regions on a torsion-resistant outer ring. The rotor can be rotated about a rotational axis which is offset in relation to the middle axis of the central element and the outer ring. In this way, conveyor cells or working spaces at first increasing and then decreasing in size are formed during a rotational motion of the rotor between the vane elements. Through the change in volume of the conveyor cells, fluid is at first suctioned into the conveyor cells and then ejected again. The end regions of the vane elements slide on the central element or the outer ring. Such a vane cell pump can be manufactured simply and economically.

To increase efficiency, a vane cell pump in the form of a pendulum slide valve pump is known from DE 195 32 703 C1. Here the vane elements are moveably accommodated in an inner rotor against which they are maintained pivotable in an annular outer rotor. The axis of rotation of the inner rotor is offset in relation to the axis of rotation of the outer rotor, which likewise causes conveyor cells to form which increase and decrease in size during operation. The pendulum slide valve pump from DE 195 32 703 C1 is nonetheless too complex and consequently expensive in manufacture.

SUMMARY

The present disclosure provides a vane cell pump which has a high degree of efficiency and at the same time can be simply and economically manufactured and assembled.

In accordance with the present disclosure, the guiding path is provided in a guide ring in the vane cell pump mentioned at the beginning.

The configuration in accordance with the present disclosure of the vane cell pump with a guide ring having a guiding path possesses the basic advantage first that the vane cell pump is basically more simply constructed, second that the components are configured more simply. Therefore, it can also be basically more easily installed. The guide ring serves to guide the guiding block so that the latter always, that is, in every operating situation of the vane cell pump, lies on the internal circumferential surface of the stator, and indeed also independently of the rotational speed of the vane cell pump. The guiding path is accordingly a forced guide for the guiding blocks which guarantees their permanent and fluid-tight seating on the internal circumferential surface.

The configuration of the forced guide as a guide ring possesses the basic advantage that the working chambers of the vane cell pump are continuously axially accessible and not closed off by control or guide elements. No special penetrations need be provided which moreover would disturb the flow of the working fluid.

In connection with a further development of the present disclosure, it is provided that the guide ring is set up on the front side on the stator and the guiding block. This configuration makes an easy assembly possible, since merely the guide ring needs to be clipped onto the axial front faces of the guiding blocks. Moreover, the guiding blocks can be installed to the internal circumferential surface of the stator until the guide ring is fixed in place using a special installation tool, for example.

In accordance with the present disclosure, the guide ring has a basically C-shaped cross section, that is, a laterally open cross section with two free segments and a depression running in the circumferential direction, especially an annular groove. Such a guide ring can be simply manufactured and can be easily installed, since it possesses no undercuttings and since the ring is constructed for the front side as well as for the rear side, that means identically for both front faces of the pump.

The stator and the guiding blocks can be accommodated free of play through an exact processing of the groove. Moreover, the two free segments of the guide ring point axially toward the interior. The guide ring possesses a flat base forming the exterior of the ring which lies, for example, on a sealing lid.

The two free segments of the guide ring embrace the front side of the stator and thus define the position of the ring with respect to the stator and consequently inside the vane cell pump. In this way, the stator is also fixed in place in the pump.

In accordance with one form of the present disclosure, one of the two free segments of the guide ring, especially the radially inner segment, engages into a front side depression of the guiding blocks. The front side depression is a groove that forms a partial ring. This intervention of the free segment of the guide ring into the groove of the guiding block forms a gearing and guarantees the secure installment of the guiding block on the internal circumferential surface of the stator even if an underpressure is prevailing in the working spaces, for example, during the suction phase.

In one form, the cross section of the front face region of the guiding block is C-shaped, that means laterally open, and the depression is flanked by two segments jutting axially toward the outside. The guide ring and the guiding block are accordingly both constructed C-shaped and engage gearing into one another in that the two sides have the grooves face each other.

Preferably the radially inner segment of the guiding block lies on the radial internal circumferential surface of the guide ring. In this way, an additional guidance is attained so that it is not only guaranteed that the guiding block does not disengage from the internal circumferential surface of the stator, but also that at high speed, a part of the contact pressure of the guiding block is absorbed by the guide ring. Moreover, due to this configuration of the guiding block and the guide ring, the guide pad is actively carried along and guided by the guide ring during actuation of the vane cell pump in the direction of a greater or lesser conveyance performance. This means that the guiding blocks are not only guided in the circumferential direction but also in a radial direction.

Another form of the present disclosure provides that the axial front side of the radially inner segment of the guiding block and the axially outer front side of the guide ring lie on the same plane. Moreover, in another form of the disclosure, the axially outer front side of the guide ring and the axial front sides of the vanes lie on substantially the same plane. In this way, the possibility is created for every working space to be closable in a simple manner by a plane surface of the cover which lies on the two axial front sides of the guiding block and the guide ring. Moreover, a fluid-tight seating can be guaranteed through a front face processing of the guide ring as well as of the guiding blocks and the front side surfaces of the vanes.

Further advantages, features and particularities of the invention become apparent from the dependent claims as well as the subsequent description in which an especially preferred embodiment is described in detail with reference to the drawings. Moreover, the features represented in the drawings as well as features mentioned in the description and the claims can be employed in each case individually by themselves or in any desired combination while remaining within the scope of the present disclosure.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

In order that the invention may be well understood, there will now be described an embodiment thereof, given by way of example, reference being made to the accompanying drawing, in which.

DETAILED DESCRIPTION

The following description is merely exemplary in nature and is not intended to limit the present disclosure, application, or uses.

For a better understanding of the invention, reference is being made to the full content of DE 10 2005 048 602, the contents of which have been incorporated herein by reference in their entirety.

Figure 1:
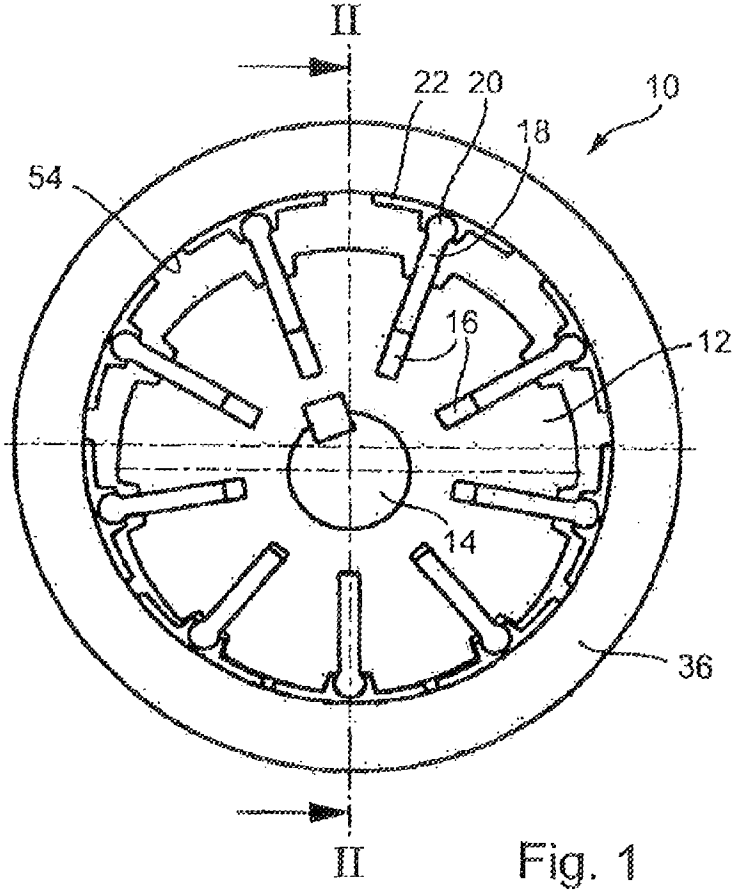
FIG. 1 depicts a side view of the vane cell pump of the invention.
Figure 3:
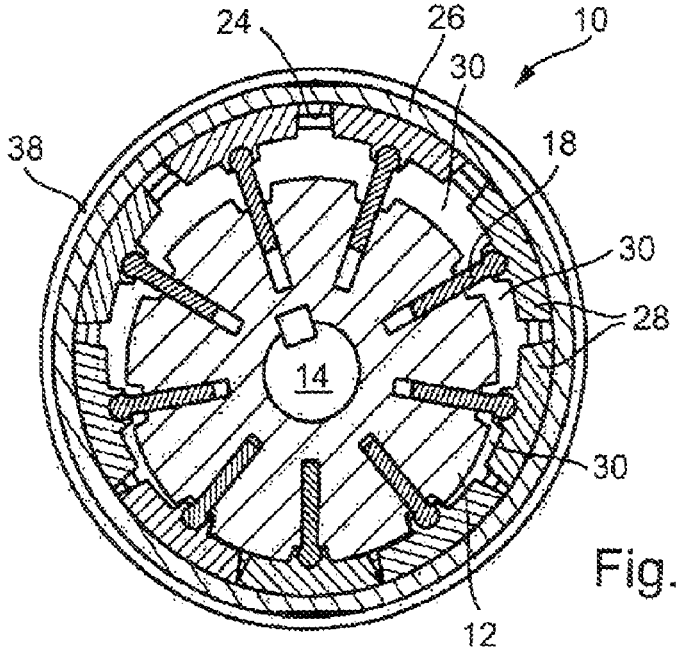
FIG. 3 depicts a section III-III in accordance with FIG. 2.

FIG. 1 shows a side view of a vane cell pump designated overall with 10 which has an inner rotor 12 that is driven by a drive shaft 14. The inner rotor 12 possesses radial slots 16 in which respectively a vane 18 is mounted moveably in the radial direction. The vane 18 has a thick outer end 20 on which a guiding block 22 is pivotably mounted. This guiding block lies, as is apparent from FIG. 3, on the internal circumferential surface 24 of a stator 26. These guiding blocks 22 form an outer rotor 28 which rotates together with the inner rotor 12 in the circumferential direction with reference to the stator 26. The vanes 18, the inner rotor 12 and the guiding blocks 22 form together with the stator 26 working spaces which increase and decrease in size again when the inner rotor 12 circulates.

It can be inferred from FIG. 4 that a guide ring 36 is set up on the front sides 32 and 34 of the stator as well as of the guiding blocks 22, which is described in greater detail below.

Figure 2:
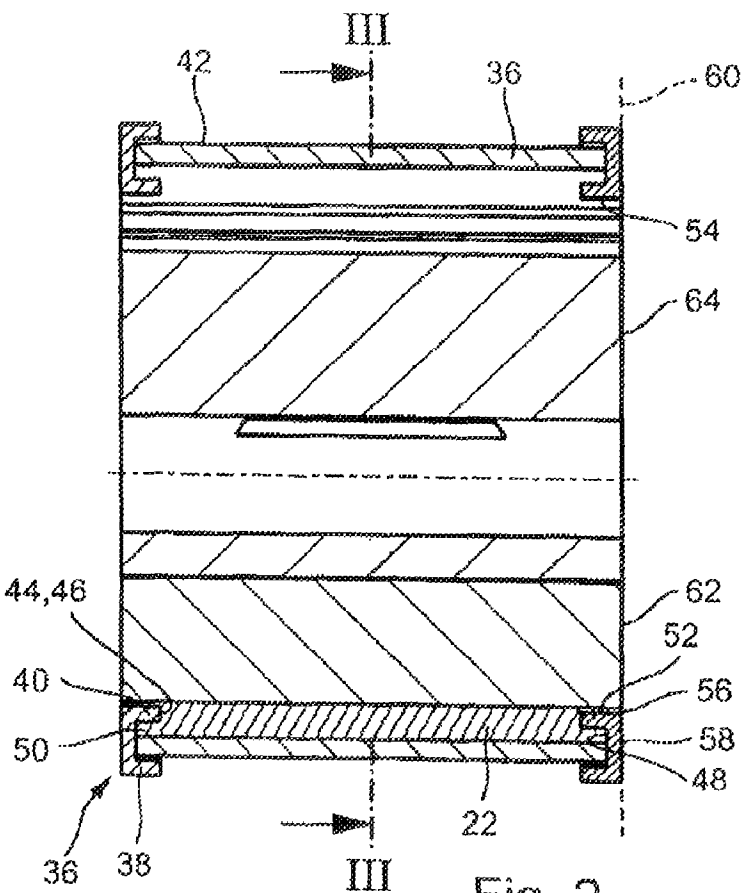
FIG. 2 depicts a section II-II in accordance with FIG. 1.
Figure 4:
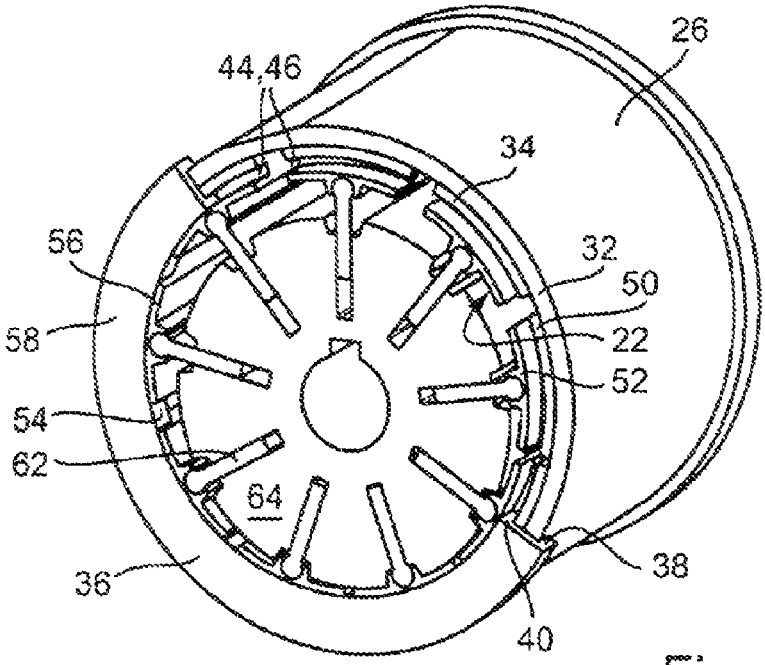
FIG. 4 is a perspective representation of the vane cell pump with a partial inside view of the guide ring.

The guide ring has, as is apparent from FIGS. 2 and 4, a C-shaped cross section, whereby the two segments 38 and 40 are oriented parallel in relation to each other and point axially toward the inside. The segment 38 embraces the edge side of the stator 26 on its radial exterior 42 and the inner segment 40 engages in a depression 46 constructed as groove 44 on the front side 34 of the guiding block 22. This is clearly recognizable in FIGS. 2 and 4. In this way, the guiding block 22 is held on the internal circumferential surface 24 of the stator 26. Accordingly, the guide ring 36 has a guide groove 48 between its two segments 38 and 40 into which, as already mentioned, the edge of the front side 32 of the stator 36 and a radially outer segment 50 of the C-shaped configured front side 34 of the guiding block 22 engages. The other segment 52 into which the free end of the vane 18 is pivotably mounted lies on the internal circumferential surface 54 of the guide ring 36. In this way, a forced guide of the guiding blocks 22 in the circumferential direction as well as in the radial direction is created.

It is moreover apparent from FIG. 2 that the front side 56 of the segment 52 of the guiding block 22 and the axially outer front face 58 of the guide ring 36 lie on a common plane 60. Moreover the axial front side 62 of each vane 18 lies in this plane. Finally the axial front side 64 of the inner rotor 12 additionally lies on this plane. This creates a simple way to close the working spaces 30 by simply putting a plane cover on. Moreover, it is easily recognizable that the vane cell pump 10 of the disclosure can easily be installed and is constructed from few components.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A vane cell pump comprising an outer rotor, an inner rotor and a plurality of vanes which are mounted radially movable essentially in radial slots in the inner rotor and secured in a pivotable manner to the outer rotor, whereby guiding blocks slide along internal circumferential surface of a stator and are guided with their axial front sides in a guiding path, wherein the guiding path is provided in a guide ring, wherein the guide ring has a basically C-shaped cross section with two free segments and a depression running in the circumferential direction, especially a groove, and wherein one of the two free segments of the guide ring engages into a front side depression of the guide blocks.

2. The vane cell pump according to claim 1, wherein the depression is an annularly running groove.

3. The vane cell pump according to claim 1, wherein a cross section of the front side region of the guiding block is C-shaped and the depression is flanked by two segments jutting axially outward.

4. The vane cell pump according to claim 3, wherein a radially inner segment of the guiding block lies on a radial internal circumferential surface of the guide ring.

5. The vane cell pump according to claim 4, wherein an axial front side of the radially inner segment of the guiding block and an radially outer front side of the guide ring lie on a common plane.

6. A vane cell pump consisting of an outer rotor an inner rotor and a plurality of vanes which are mounted radially moveable essentially in radial slots in the inner rotor and are secured in a pivotable manner to the outer rotor whereby the outer rotor is formed by guiding blocks, whereby the guiding blocks slide along an internal circumferential surface of a stator and are guided with their axial front sides in a guide track which is provided in a guide ring, the guide ring has a basically C-shaped cross section with two free segments and a depression running in a circumferential direction, especially a groove, and the two free segments of the guide ring point axially inward and embrace the front side of the stator, wherein one of the two free segments of the guide ring engages into a front side depression of the guiding block, and is constructed as an annularly running groove.

7. The vane cell pump according to claim 6, wherein the guide ring is set up on the front side the stator and the guiding blocks.

8. The vane cell pump according to claim 6, wherein a cross section of the front side region of the guiding block is C-shaped and the depression is flanked by two segments jutting axially outward.

9. The vane cell pump according to claim 8, wherein a radially inner segment of the guiding block lies on the radial internal circumferential surface of the guide ring.

10. The vane cell pump according to claim 9, wherein an axial front side of the radially inner segment of the guiding block and a radially outer front side of the guide ring lie on a common plane.

11. The vane cell pump according to claim 6, wherein an axial outer front face of the guide ring and an axial front side of the vane lie on a common plane.

12. The vane cell pump according to claim 6, wherein an axially outer front face of the guide ring and an axial front side of the inner rotor lie on a common plane.

* * * * *